United States Patent [19]

Huffman

[11] Patent Number: 4,504,013

[45] Date of Patent: Mar. 12, 1985

[54] APPARATUS FOR DISCHARGING TWO COMMINGLED FLUIDS

[75] Inventor: David C. Huffman, Wilton, N.H.

[73] Assignee: Spraco, Inc., Nashua, N.H.

[21] Appl. No.: 410,590

[22] Filed: Aug. 23, 1982

[51] Int. Cl.[3] ..... B05B 7/06

[52] U.S. Cl. ..... 239/424; 239/433

[58] Field of Search ..... 239/418, 421, 423, 424, 239/426, 432, 433, 521

[56] References Cited

U.S. PATENT DOCUMENTS

| | | | |
|---|---|---|---|
| 256,133 | 4/1882 | Douglas | 239/424 |
| 272,863 | 2/1883 | Douglas | 239/424 |
| 1,178,604 | 4/1916 | Talbott | 239/424 |
| 1,279,315 | 9/1918 | Foerst | 239/424 |
| 1,767,462 | 6/1930 | Lammert et al. | 239/424 |
| 2,361,144 | 10/1944 | Loepsinger | 239/424 |
| 2,626,836 | 1/1953 | Herron | 239/521 |
| 2,973,150 | 2/1961 | Golec | 239/424 |
| 3,066,872 | 12/1962 | Kobee | 239/424 |
| 3,394,888 | 7/1968 | Dasse et al. | 239/424 |
| 3,507,589 | 4/1970 | Keller | 239/424 |
| 4,392,617 | 7/1983 | Bakos et al. | 239/290 |

OTHER PUBLICATIONS

Spray Head No. DF11 144.213.30.00.00.0-*Drawing*-of Lechler GmbH & CO KG, Date unknown but prior to applicant, Fellbach, West Germany.

Spray Head No. F3B 40100-122435, set-up Drawing-of Spraying Systems Co., Date unknown but prior to applicant, Wheaton, Illinois 60187.

*Primary Examiner*—Jeffrey V. Nase
*Assistant Examiner*—Jon M. Rastello
*Attorney, Agent, or Firm*—Charles Hieken

[57] ABSTRACT

A spray head having a body provided with separate inlets for two fluids, the inlets having a common longitudinal axis and being in end abutting relation. One inlet leads to a chamber for receiving one of the fluids, the chamber being provided with means through which the fluid is discharged, and the other inlet leads to a post, manufactured simultaneously with the manufacture of the chamber and integral with the body. The post is located in the chamber and is hollow so that the other fluid is discharged therefrom by the aspirating action of the first, and the two fluids are commingled, the second fluid being atomized by the first. Various nozzle structures are disclosed from which the commingled discharges flow, the ultimate discharge being in the form of a cone, or a flat fan by the employment of opposed supplemental fluid jets, or non-circular in formation as shaped by appropriate terminus aperturing, or flattened and diverted by impact with an impingement surface in the path of the discharge.

8 Claims, 11 Drawing Figures

APPARATUS FOR DISCHARGING TWO COMMINGLED FLUIDS

BACKGROUND OF THE INVENTION

1. Field of the Invention

The present invention relates to fluid discharge apparatus in which two fluids having separate flow paths become a commingled discharge. More particularly, the present invention relates to such apparatus in which the separate flow paths are in end abutting relation having a common longitudinal axis, the separately supplied streams having a single axis of confluence such that one flow path surrounds the other.

2. Description of the Prior Art

Representative U.S. Pat. Nos. showing separately produced and mounted nozzles, each supplied from a separate fluid inlet and being co-axial so that the commingled fluids have a single axis of confluence with one fluid surrounding the other are:

256,133, Douglas, Apr. 11, 1882
272,863, Douglas, Feb. 27, 1883
1,279,315, Foerst, Sept. 17, 1918
1,767,462, Lammert et al., June 24, 1930
2,361,144, Loepsinger, Oct. 24, 1944
2,912,064, Friedell, Nov. 10, 1959
2,973,160, Golec, Feb. 28, 1961
3,066,872, Kobee, Dec. 4, 1962
3,394,888, Dasse et al., July 30, 1968

In the Douglas, Lammert et al., Friedell, and Dasse nozzles the commingling of two fluids is initiated somewhat downstream of the discharge terminus, while the Foerst, Loepsinger, Golec, and Kobee patents provide that the commingling of the two fluids be initiated at the terminus itself. But in every one of these structures the two nozzles are each separately manufactured and separately assembled with the remainder of the structure, and there is no showing or teaching in any of them of the inner nozzle being integral with the body structure, thereby eliminating any danger of such a nozzle being out of line or out of co-axiality with cooperating structure which depends upon the accuracy which follows from integrality. Where an inner nozzle is separately manufactured and mounted, the structure receiving the nozzle must be machined or otherwise prepared with the assembly end in view that the nozzle axis be properly directed, and this result is achieved automatically, as it were, where the nozzle is fabricated integrally with the nozzle body structure, as is explained below.

For U.S. Pat. Nos. showing nozzles with the separate flow paths for fluid being in end abutting relation there are:

1,326,996, Trahan, Jan. 6, 1920
2,729,844, Wilson, Mar. 27, 1956 but these do not disclose flow paths such that one surrounds the other, and the integral parts disclosed are not discharge elements at all but merely path separators.

The nearest art known to the inventor is Talbott, U.S. Pat. No. 1,178,604, Apr. 11, 1916, for a burner using steam and oil. While it may well be questioned just how, as disclosed, the burner is manufactured, the concealed inner nozzle is integral with body structure. Manufacture by casting was probably contemplated by Talbott, and this requires pattern equipment and finishing operations completely obviated by machining rod stock blanks as disclosed herein for the present invention.

BRIEF SUMMARY OF THE PRESENT INVENTION

The present invention contemplates the provision of apparatus in which separate fluid streams, such as air and liquid to be atomized, are introduced into a spray head by separate inlets, each out of communication with the other, there being an area for receiving one of said fluids directly, and discharge means in the area communicating with the other of said inlets whereby both fluids are discharged co-axially in a commingled condition, one fluid surrounding the other. The present invention also contemplates the use of various nozzle structures each as a terminus for the commingled discharge.

DETAILED DESCRIPTION OF THE PREFERRED EMBODIMENT OF THE PRESENT INVENTION, AND MODIFICATIONS THEREOF

Figure 1:
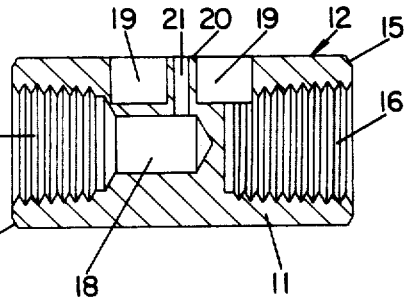
FIG. 1 is a view of the body in side sectional elevation showing the two inlet passages, the chamber, and the hollow integral post.
Figure 2:
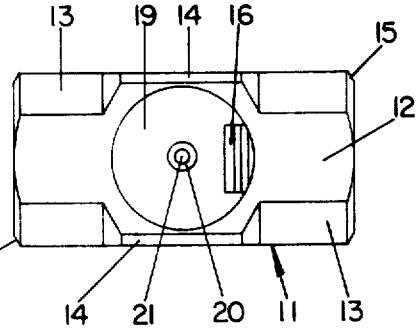
FIG. 2 is a view in plan of the FIG. 1 body.

Referring to the drawing, there is shown in FIGS. 1 and 2 a somewhat elongated unitized body 11 which is preferably polygonal in transverse cross section and is shown as made from square rod stock to provide a flat face 12 generally perpendicular to opposed first and second end faces extending from the first end face to the second end face. The body 11 is variously chamfered as shown at 13, 14, and 15 to eliminate 90° edges and sharp corners, thereby to facilitate handling and assembly with equipment (not shown) needed for the operation of embodiments of the present invention.

At one end the body 11 is provided with a threaded inlet passage 16 for reception of conventional equipment leading from a source (not shown) of fluid under pressure which, for purposes of this part of this exposition, may be considered as compressed air. At its opposite end the body 11 is provided with a second inlet passage 17 for reception of conventional equipment leading from a source (not shown) of a different fluid which, for purposes of this part of this exposition, may be considered as water, oil, or some other liquid composition to be atomized. As shown in FIG. 1, the inlet passage 17 has less depth than the inlet passage 16, and at its inner end has a hollow cylindrical extension 18 of reduced diameter the closed end of which is beyond the center of the body 11 in the direction of the inlet passage 16. As shown in FIG. 1 the two passages 16 and 17 are substantially co-axial as a matter of ease in manufacture and embodiment installation with equipment, and are out of communication with each other.

Extending inwardly from an exterior and exposed flat face 12 of the body 11 and interjacent its ends is a cylindrical chamber 19 the depth of which is sufficient to intersect the inlet passage 16 so as to be in direct communication therewith as shown in FIGS. 1 and 2, and extending upwardly and centrally into the chamber 19 is a cylindrical post 20 which is integral with the material of the body 11. The post 20 overlies the inlet extension 18 as it were (FIG. 1), and is tubular, i.e., is provided with a central cylindrical flow-confining jet-producing passage 21 which inwardly intersects the extension 18 so as to be in communication therewith and thus with the inlet passage 17. As shown in FIGS. 1 and 2, the upper or discharge end of the post 20 terminates at the plane of the body face 12 from which the chamber 19 inwardly extends, and is in communication with the inlet passage 17 and out of communication with the inlet passage 16. The inlet passage 17 and its extension 18 thus form the area of communication to the post passage 21 for discharge of fluid introduced into inlet passage 17.

The structure so far described and illustrated in FIGS. 1 and 2 is an integer, being wholly one piece of material, and functions as the foundation element, as it were, for a spray head assembly construction to be completed with nozzle structure. In order to produce the integer as such, a body blank (preferably after the chamfering and formation of the inlet passages 16 and 17) is secured in a holder mounted on the spindle of a turret lathe, the body face 12 from which the chamber 19 is to extend inwardly being at 90° to the axis of rotation of the spindle and the portion of the body 11 to become the post 20 being located in the holder so as to be co-axial with the axis of rotation of the spindle. Mounted on the turret of the lathe for co-axiality with the spindle is a trepanning tool, and at the next station of the turret is a drill also to become co-axial with the spindle.

Figure 10:
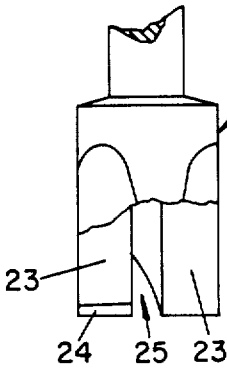
FIG. 10 is a view in elevation representing a three-blade trepanning tool for producing the chamber and the preliminarily solid integral post in the chamber.
Figure 10A:
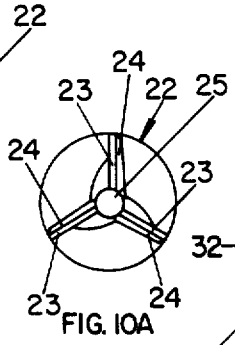
FIG. 10A is a view in underside plan of the FIG. 10 tool.

One example of a trepanning tool is shown conventionally in FIGS. 10 and 10A, the tool 22 there shown having three blades 23 merely for sake of illustration, each with relief bevelling 24. The tool has a central cylindrical axial passage 25 the cutting edge of which is also relieved as is well understood and therefore not shown in the drawing. The operational width (diameter) of the tool 22 (FIG. 10A) is the same as that of the body chamber 19, therefore to produce the chamber, and the diameter of the passage 25 is the same as that of the post 20, therefore to produce the post. The diameter of the drill in the next turret station is the same as that of the post passage 21, therefore to produce the passage. The turret is reciprocated on its slide so that the trepanning tool and the drill are successively engaged with the body 11, and the turret mechanism is provided with stops such that the trepanning tool causes the chamber 19 to intersect the inlet passage 16 (FIGS. 1 and 2) but be spaced from the shortened inlet passage 17, and to cause the drill to form the post passage 21 deep enough to intersect the inlet extension 18.

An alternative way of machining the body integer to form the chamber 19 and the tubular post 20 is to provide a single-blade trepanning tool (not shown) the width of the cutting edge of which equals the radial space between the wall of the chamber 19 and the post 20. Such a tool blade per se would resemble one of the blades 23 in FIGS. 10 and 10A, and would be mounted on a tool post sufficiently offset laterally from the axis of rotation of the lathe spindle to produce the post 20 while simultaneously cutting into the body 11 to form the chamber 19. The post passage 21 would then be produced by drilling as stated above.

With either of the above methods of making the body integer, it will be seen that the cylindrical chamber 19, the post 20, and the post passage 21 are necessarily accurately co-axial in contrast to the angular aberration-possible situaion that might well exist if the post 20 were a physically separate piece to be frictionally press-fitted or threaded into the base of the chamber 19 in a suitable opening therein prepared separately and in advance for co-axiality with the post.

Figure 3:
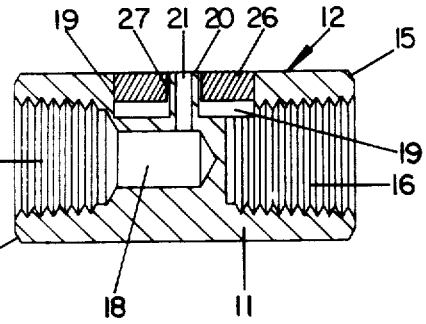
FIG. 3 is a view of the FIG. 1 body with the nozzle, in the form of a centrally apertured disc, frictionally press-fitted into the chamber so as to be mounted therefrom.
Figure 4:
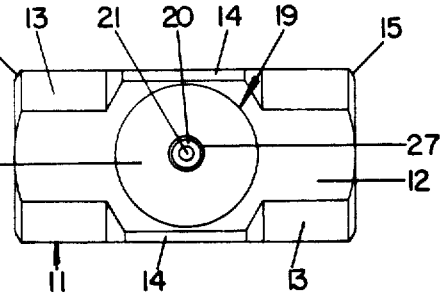
FIG. 4 is a view in plan of the FIG. 3 showing.

In FIGS. 3 and 4 there is shown the preferred embodiment of the present invention comprising a completed spray head construction having a nozzle in the shape of a disc 26 provided with an open portion consisting of a central opening 27 circular in cross section. The outer face of the disc 26 is preferably flush (FIG. 3) with the face 12 of the body 11 having the open end of the chamber 19 and is also flush with the discharge end of the post 20. The diameter of the disc opening 27 is somewhat greater than the diameter of the post 20 so that the post is laterally spaced from the opening 27, and the thickness of the disc 26 is less than the depth of the chamber 19 so that a flow discharge passage is provided for the fluid from the inlet passage 16 to the atmosphere consisting of (a) the space between the disc 26 and the bottom of the chamber 19, and (b) the hollow cylindrical passage between the post 20 and the wall of the disc passage 27. The disc 26 is frictionally press-fitted into the chamber 19 in engagement with its wall so that as a nozzle the disc 26 is mounted from the chamber wall.

Figure 5:
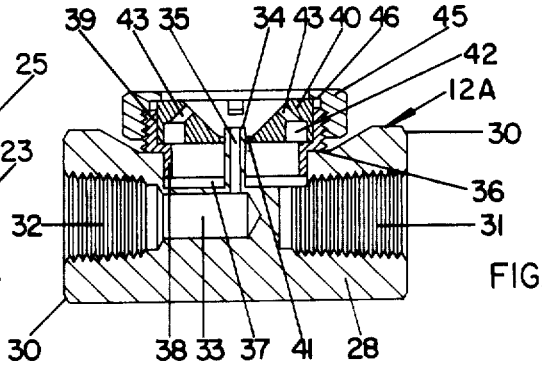
FIG. 5 is a view in side sectional elevation showing a slightly modified body, and mounted from the chamber a nozzle provided with supplemental fluid jets for changing the shape of the discharge from the nozzle.
Figure 6:
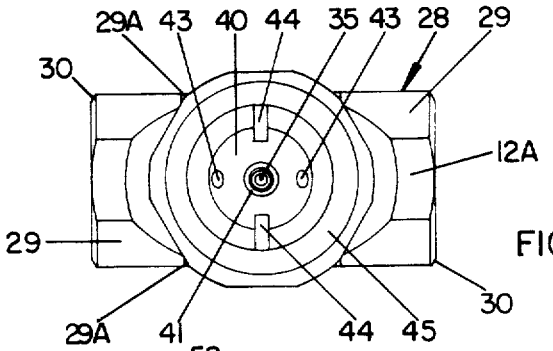
FIG. 6 is a view in plan of the FIG. 5 showing.

A modified spray head construction embodying the present invention is shown in FIGS. 5 and 6, but the body 28, while functionally identical with the body 11, is slightly structurally different because of the provision for the discharge of fluid supplementally upon the main discharge.

The body 28 is somewhat elongated and is also preferably made from square rod stock, being variously chamfered at 29, 29*a*, and 30 for the same purpose as stated above for chamfering the body 11. The body 28 is provided with threaded inlet passages 31 and 32 which are somewhat smaller in cross section than the FIGS. 1–4 respective inlet passages 16 and 17 but are functionally identical with them; the passage extension 33 and the post 34 correspond functionally to the extension 18 and post 20, respectively, in FIGS. 1–4; and the hollow cylindrical interior passage 35 of the post 34 has the same function as the passage 21 in the post 20 in FIGS. 1–4. The two inlet passages 31 and 32 are substantially co-axial; the inlet passage 31 is out of communication with the inlet passage 32; and the inlet passage 32 and its extension 33 form the area of communication to the post passage 35 for discharge of fluid introduced into the inlet passage 32, all corresponding to the body 11 structure in FIGS. 1–4.

As shown in FIGS. 5 and 6 the body has an exterior and exposed flat face which is given the reference numeral 12*a* because it corresponds to the exterior and exposed flat face 12 in FIGS. 1–4, but this face 12*a* is partially inwardly dished, and extending inwardly from the flat surface portion 36 thus formed and interjacent the ends of the body 28 is a cylindrical chamber 37 corresponding to the chamber 19 in FIGS. 1–3. The depth of the chamber 37 is sufficient to intersect the inlet passage 31 so as to be in direct communication therewith, and the cylindrical post 34, which is integral with the body 28, extends upwardly and centrally into the chamber 37. The post 34 overlies the inlet passage extension 33, as it were, and is provided with the central cylindrical passage 35 which inwardly intersects the extension 33 so as to be in communication therewith and thus with the inlet passage 32. For a reason stated below, the upper or discharge end of the post 34 preferably extends beyond the plane of the surface 36 of the body 28 and terminates at the plane of the flat face 12*a*. The chamber 37, the post 34 and the post passage 35 may be produced by trepanning and drilling, as stated above for the body 11 in FIGS. 1–4.

The chamber 37 receives, frictionally press-fitted in place, the cylindrical skirt 38 of a cup 39 which in turn receives rotatably the flat bottom of a nozzle 40 having a central opening 41 of slightly greater diameter than that of the post 34, thereby providing an open portion circular in cross section, laterally spaced from the post 34 and functioning as a discharge passage from the chamber 37 by way of the interior of the skirt 38. Completing the nozzle 40 structure is an annular groove 42 in the under face of the nozzle in communication with the interior of the skirt 38 and therefore of the chamber 37, and communicating with the annular groove 42 are diametrically opposite, inwardly converging ports 43 for discharging fluid against the discharge from the post 34 and the surrounding central opening 41. Rotative adjustment of the nozzle 40 in the cup 39 is facilitated by diametrically opposite wrench slots 44, and with the position of the nozzle 40 adjusted, a cap 45 having an annular shoulder 46 is turned on the threaded exterior of the cup 39 in engagement with the nozzle 40 to hold it in place. The nozzle 40 is mounted from the chamber 37 by the cup 39.

In using the preferred embodiment (FIGS. 1–4) of the present invention, a liquid fluid to be atomized is stored in some suitable container under only atmospheric pressure, a conduit (not shown) leading from the container to the inlet passage 17. Compressed air from a suitable controlled source (not shown) is introduced into the inlet passage 16 and from there it flows into the chamber 19 from which it is discharged to the atmosphere through the cylindrical space between the post 20 and the central opening 27 in the disc 26. Immediately upon discharge the air expands and creates a condition of unbalanced, i.e., lowered, pressure at the discharge end of the post 20 as compared to the pressure of the atmosphere on the stored liquid, with the result that liquid is withdrawn by an aspirating action from its container into the inlet passage 17 from which it flows through the inlet extension 18 and then to the atmosphere through the passage 21 in the post 20. By reason of the expansion of the air, it is commingled with the liquid discharged from the post 20, with the result that there is created a conical discharge from the spray head consisting of air-atomized liquid droplets.

In using the FIGS. 5–6 embodiment of the present invention, a liquid fluid to be atomized is stored as above and a conduit (not shown) leads from the liquid container to the inlet passage 32. Compressed air from a suitable controlled source (not shown) is introduced into the inlet passage 31 and from there it flows into the chamber 37 and the interior of the skirt 38 from which it is discharged to the atmosphere through the cylindrical space between the post 34 and the central opening 41 in the nozzle 40. Immediately upon discharge the air expands and creates a condition of unbalanced, i.e., lowered, pressure at the opening 41 as compared to the pressure of the atmosphere on the stored liquid with the result that liquid is withdrawn by an aspirating action from its container into the inlet passage 32 from which it flows through the inlet extension 33 and then to the atmosphere through the passage 35 in the post 34. By reason of the expansion of the air it is commingled with the liquid discharged from the post 34, with the result that there is initiated the commingling of air and liquid for atomization of the latter in the form of a conical discharge. But such a discharge is conical for only a short distance from the discharge end of the post 34, for almost immediately such a discharge is struck from opposite sides by the jets of air discharged from the ports 43 which receive air from the annular groove 42 in communication with the interior of the skirt 38. The result is that the initially conical discharge is flattened and its shape changed into a fan-shaped spray of atomized liquid.

Referring again to FIG. 5, the reason why the upper or discharge end of the post 34 terminates beyond the plane of the surface 36 of the body 28 is that it has been found that if said upper or discharge end terminates at the plane of the surface 36, corresponding to the post 20 and upper face of the disc 26 in FIG. 3, the discharge of the jets of air from the ports 43 tends to create a back pressure against the discharged air and liquid from the central passage 41 and post passage 35, respectively, inhibiting proper formation of their commingled discharge.

Figure 7:
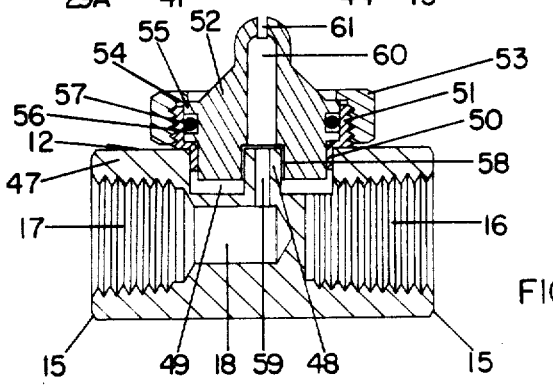
FIG. 7 is a view in side sectional elevation showing a body with a nozzle mounted from the chamber and having an apertured terminus in the form of a slot.
Figure 8:
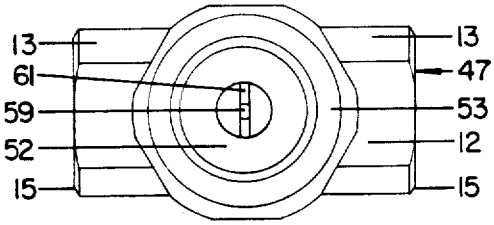
FIG. 8 is a view in plan of the FIG. 7 showing.

In FIGS. 7 and 8 there is shown another modified spray head construction embodying the present invention, the body 47 being substantially identical with that shown in FIGS. 1–4 (and to this extent is given the FIGS. 1–4 reference numerals). But the post 48 has a diameter somewhat greater than that of the post 20 in FIGS. 1–4 and the radial spacing between the post 48 and the wall of the cylindrical chamber 49 is slightly less than the corresponding spacing between the post 20 and the wall of the chamber 19 in FIGS. 1–4.

The chamber 49 is in communication with the fluid inlet passage 16 as in FIGS. 1–4 and receives frictionally press-fitted the cylindrical skirt 50 of a cup 51 which may be identical with the cup 39 in FIG. 5, and the cup 51 in turn receives rotatively the cylindrical bottom portion of a nozzle 52 so that the nozzle is mounted from the chamber 49 by the cup 51. The nozzle 52 is held in the cup 51 by an apertured cap 53 like the cap 45 in FIG. 5 threaded on the cup 51, an annular shoulder 54 on the cap 51 engaging a flange 55 on the upper portion of the nozzle 52 as shown in FIG. 7. The flange 55 is provided with an annular groove 56 receiving an O-ring 57 which functions as a seal, as will be described.

The portion of the cylindrical bottom of the nozzle 52 which is received by the cup 51 has a central cylindrical passage 58 of sufficient height (viewing FIG. 7) to receive and extend spaced above the upper portion of the post 48, the discharge end of the internal passage 59 of which terminates as disclosed at the plane of the body face 12 from which the chamber 49 inwardly extends. The diameter of the passage 58 is somewhat greater than that of the post 48 with the result that there is a cylindrical passage between the post 48 and the wall of the passage 58, and leading from the passage 58 to the discharge end of the nozzle 52 is a cylindrical passage 60 of less diameter than the diameters of the post 48 and passage 58. The discharge terminus of the passage 60 is shown as a dome provided with a slot 61, although it is within the scope of the present invention that the apertured terminus be two or more slots, or be made of a plurality of ports. The chamber 49, the post 48 and the post passage 59 in the body 47 may be produced by trepanning and drilling as stated above for the body in FIGS. 1–4.

Figure 9:
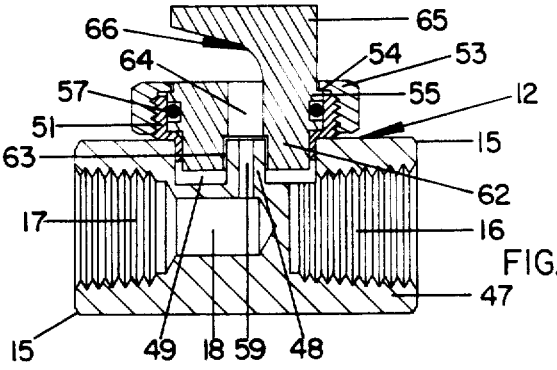
FIG. 9 is a view in side sectional elevation showing a body with a nozzle mounted from the chamber and provided with an impingement surface for changing the shape and direction of the discharge from the nozzle.

In FIG. 9 there is shown a further modified spray head construction embodying the present invention. In this embodiment the body is identical with the body 47 in FIGS. 7–8 and the corresponding parts including those common to FIGS. 1–4 are therefore given the same reference numerals for clarity in exposition.

The difference between the FIGS. 7–8 and FIG. 9 embodiments is the nozzle structure. To expand on this, the cup 51 receives rotatively the cylindrical bottom portion of the nozzle 62 which is held in place by the apertured cap 53 and cooperating structure described above for FIGS. 7–8. The nozzle flange 55, annular groove 56 and O-ring 57 of FIG. 9 are likewise identical with these elements in FIGS. 7–8, and as in FIGS. 7–8, the nozzle 62 is mounted from the chamber 49 by the cup 51.

The portion of the cylindrical bottom of the nozzle 62 which is received by the cup 51 has a central cylindrical passage 63 which, like the cylindrical passage 58 in FIGS. 7–8, is of sufficient height (viewing FIG. 9) to receive and extend spaced above the upper portion of the post 48, the discharge end of the internal passage 59 of which terminates as disclosed at the plane of the body face 12 from which the chamber 49 inwardly extends. The diameter of the passage 63 is slightly greater than that of the post 48 with the result that there is a cylindrical passage between the post 48 and the wall of the passage 63, and leading outwardly from the passage 63 to the atmosphere is a cylindrical passage 64 of less diameter than the diameters of the post 48 and passage 63. Above the discharge end of the passage 64 the nozzle body has an extension 65 a surface portion 66 of which overlies the passage 64 and acts as a deflector for spreading the discharge and changing its direction.

The spray heads shown in FIGS. 3–6 are of what is called the external mix type, by which there is meant that the commingling of the fluids takes place outside the nozzle, i.e., at or beyond the terminus or point of final discharge. But with the spray heads shown in FIGS. 7–8 and FIG. 9 this is not the case, these spray heads being of the internal mix type, by which there is meant that commingling is initiated within the nozzle. Moreover, while it is preferred that air be introduced into the inlet passages 16 and 31 in FIGS. 3–6 and liquid be introduced into the passages 17 and 32 in these Figs., in the use of the FIGS. 7–8 and FIG. 9 spray heads it is preferred that this air and liquid introduction be reversed, as will be explained.

Referring to FIG. 7, compressed air is introduced into the inlet passage 17 from which it flows into the extension 18, then into the post passage 59 and then into the domed internal passage 60 to the slot terminus 61. Liquid under pressure (conventionally supplied and pressure-controlled) is introduced into the inlet passage 16 from which it flows into the chamber 49, then into the cylindrical space between the post 48 and the nozzle passage 58, then across the discharge end of the post 48 and under the nozzle passage 60 (because the diameters of the post 48 and the passage 58 are each greater than that of the nozzle passage 60) and then through the nozzle passage 60 to the slot terminus 61. When the liquid reaches the discharge end of the post 48 it is struck by and commingled with the compressed air flowing through the post passage 59 on the way to the slot terminus 61, and the liquid is thereupon atomized within the nozzle passage 60 and is discharged through the slot 61 in such condition. The seal afforded by the O-ring 57 in engagement with the cup 51 prevents leakage of liquid from between the wall of the cylindrical bottom portion of the nozzle 52 and the engaged inner wall of the cup skirt 50.

A similar action takes place with the spray head shown in FIG. 9, compressed air introduced into the inlet passage 17 flowing through the extension 18 and the post passage 59 into the cylindrical passage 64 underlying the deflector surface 66. Liquid under pressure introduced into the inlet passage 16 flows into the chamber 49, then into the cylindrical space between the post 48 and the nozzle passage 63, then across the discharge end of the post 48 at the entrance to the nozzle passage 64 (because the diameter of the nozzle passage 64 is lesser than the diameters of the post 48 and nozzle passage 63) and then through the nozzle passage 64 to the deflector impingement surface 66. When the liquid reaches the discharge end of the post 48 it is struck by and commingled with the compressed air flowing through the post passage 59 on the way to the nozzle passage 64 and the liquid is thereupon atomized within the nozzle passage 64 and is discharged against the deflector surface in such condition. The seal afforded by the O-ring 57 in engagement with the cup 51 prevents leakage of liquid fluid from between the wall of the cylindrical bottom of the nozzle 62 and the engaged inner wall of the cup skirt 50.

It is appreciated that with the FIGS. 7–8 and FIG. 9 constructions compressed air could be introduced into the inlet passage 16 and liquid under pressure could be introduced into the inlet passage 17, but this is not recommended because the discharge through the post passages would, in each case, then be liquid under pressure and the fluid struck by such a discharge would be compressed air, resulting in inferior atomization of the liquid. Likewise in the FIGS. 3–6 spray heads compressed air could be introduced into the respective inlet passages 17 and 32 and liquid could be introduced into the respective inlet passages 16 and 31, but this would require putting the liquid under pressure and would result in the discharge of compressed air through the respective post passages 21 and 35 surrounded by a hollow sheath, as it were, of liquid from the respective cylindrical passages between the posts 20 and 34 and their associated nozzle openings 27 and 41. Experience has shown that a central core of liquid surrounded by a hollow sheath of expanding air is better atomized, with a given air pressure, than is a central core of air surrounded by a hollow sheath of liquid under that same pressure.

On the subject of pressures, for the FIGS. 3–6 constructions the air pressures used may vary from 10 psi to 60 psi, depending upon the volume of atomized liquid fluid to be discharged. For the FIGS. 7–8 and FIG. 9 constructions, the liquid fluid pressure may vary from 5 psi to 100 psi or better, depending upon the flow volume desired, and for these the air pressure may vary from 5 psi to 120 psi or better, depending upon the degree of atomization desired.

What is claimed as new is:

1. In a spray head, apparatus comprising, a unitized body having an exterior and exposed flat face generally perpendicular to opposed first and second end faces extending from said first end face to said second end face, said body also having a first inlet passage for a fluid extending from said first end face generally parallel to said flat face and a second inlet passage for a different fluid extending from said second end face generally parallel to said flat face, said passages being located in the body inwardly with respect to said flat face and out of communication with each other, a cylindrical chamber in the body extending from said flat face inwardly thereof and being open at its top, said chamber being in communication with one only of said inlet passsages, a post having an inlet and an outlet, a nozzle mounted from the chamber about the exterior of said post outlet in said chamber and having an open portion functioning as a discharge passage from said chamber, said post being integral with the body and extending therefrom into said chamber and also into said nozzle open portion in laterally spaced relation to both the chamber and the nozzle open portion, said post terminating at the plane of said flat face and having a flow-confining jet-producing passage extending through the post from the post inlet to the post outlet at its terminus at said plane for discharge of fluid from an area of communication with only the other of said inlet passages, said flow-confining jet-producing passage having the form of a hollow unobstructed cylinder between the post inlet and post outlet, said post inlet being in direct communication with said other of said inlet passages.

2. Structure such as recited in claim 1 characterized by the fact that the nozzle is an apertured disc frictionally fitted in the chamber with the exposed face of the disc substantially in the plane of said body flat face.

3. Structure such as recited in claim 1 characterized by the fact that the nozzle is provided with diametrically opposite, axially converging ports in communication with the chamber for discharging fluid supplementally against the commingled discharge from the post and nozzle open portion to change the shape of said discharge.

4. Structure such as recited in claim 1 characterized by the fact that the nozzle is provided with an impingement deflector surface in the path of the commingled discharge from the post and nozzle open portion to change the shape and direction of said discharge.

5. Structure such as recited in claim 1 characterized by the fact that the terminus of the nozzle discharge passage is apertured.

6. Structure such as recited in claim 1 characterized by the fact that the inlet passages are located at opposite ends, respectively, of the body and are substantially co-axial, with the chamber being located in the body interjacent said ends.

7. Structure such as recited in claim 1 wherein said first passage is longer than said second passage and terminates in a hollow cylindrical extension of reduced diameter having a closed end extending beyond the center of said body in the direction of said second passage, the depth of said cylindrical chamber being sufficiently great to intersect said second passage while being sufficiently shallow to avoid intersection with said first passage.

8. Structure such as recited in claim 7 wherein said first and second passages are coaxial.

* * * * *